US007223929B2

(12) United States Patent
Dumont

(10) Patent No.: US 7,223,929 B2
(45) Date of Patent: May 29, 2007

(54) FRONT OR SIDE CONTROLLED ELECTRICAL SHUTOFF APPARATUS

(75) Inventor: Roger Dumont, Benfeld (FR)

(73) Assignee: Socomec S.A., Benfeld (FR)

( * ) Notice: Subject to any disclaimer, the term of this patent is extended or adjusted under 35 U.S.C. 154(b) by 0 days.

(21) Appl. No.: 11/242,728

(22) Filed: Oct. 4, 2005

(65) Prior Publication Data

US 2006/0070862 A1 Apr. 6, 2006

(30) Foreign Application Priority Data

Oct. 6, 2004 (FR) ..... 04 10526

(51) Int. Cl.
*H01H 9/20* (2006.01)

(52) U.S. Cl. ..... 200/50.05; 200/329; 200/331; 200/43.11; 200/17 R

(58) Field of Classification Search ..... 200/1 R, 200/16 R–16 C, 17 R, 400, 401, 405, 415, 200/416, 419, 424, 425, 428–431, 434, 436, 200/453, 459, 468, 500, 501, 564, 572, 329, 200/330, 331, 334, 336
See application file for complete search history.

(56) References Cited

U.S. PATENT DOCUMENTS 4,963,706 A * 10/1990 Mohtasham ..... 200/334
5,886,311 A * 3/1999 Morel et al. ..... 200/17 R
5,894,116 A * 4/1999 Da Dalt ..... 200/43.04
6,100,485 A * 8/2000 Mortun et al. ..... 200/572
6,576,851 B1 * 6/2003 Barlian et al. ..... 200/5 R
6,627,827 B2 * 9/2003 Kiong Low et al. ..... 200/47
6,989,499 B2 * 1/2006 Bortolloni et al. ..... 200/50.05

FOREIGN PATENT DOCUMENTS

| | | |
|---|---|---|
| DE | 1640682 | 9/1970 |
| DE | 4300313 | 3/1994 |
| EP | 0823720 | 2/1998 |

* cited by examiner

*Primary Examiner*—Michael A. Friedhofer
(74) *Attorney, Agent, or Firm*—Davis Bujold & Daniels, P.L.L.C.

(57) ABSTRACT

The present invention concerns a shutoff apparatus that can be controlled In either front or side mode, consisting of a minimum number of parts and resulting in a simple, economical, mechanically dependable, and compact unit. The shutoff apparatus (1) includes a rotating control element (20) in the shape a star with four branches (22), provided with a profiled extremity (25) and connected to the control rod (5) oriented toward one of the other of the two control axes (A, B) corresponding to front and lateral control modes, respectively. The present invention has a transmission element (30) connected to movable contacts (7) and equipped with inclined ramps transforming rotational movement by the control element (20) on one or the other of the two control axes (A, B) into translational movement by the movable contacts (7) between the released and engaged positions, and conversely.

14 Claims, 8 Drawing Sheets

FIG. 3B
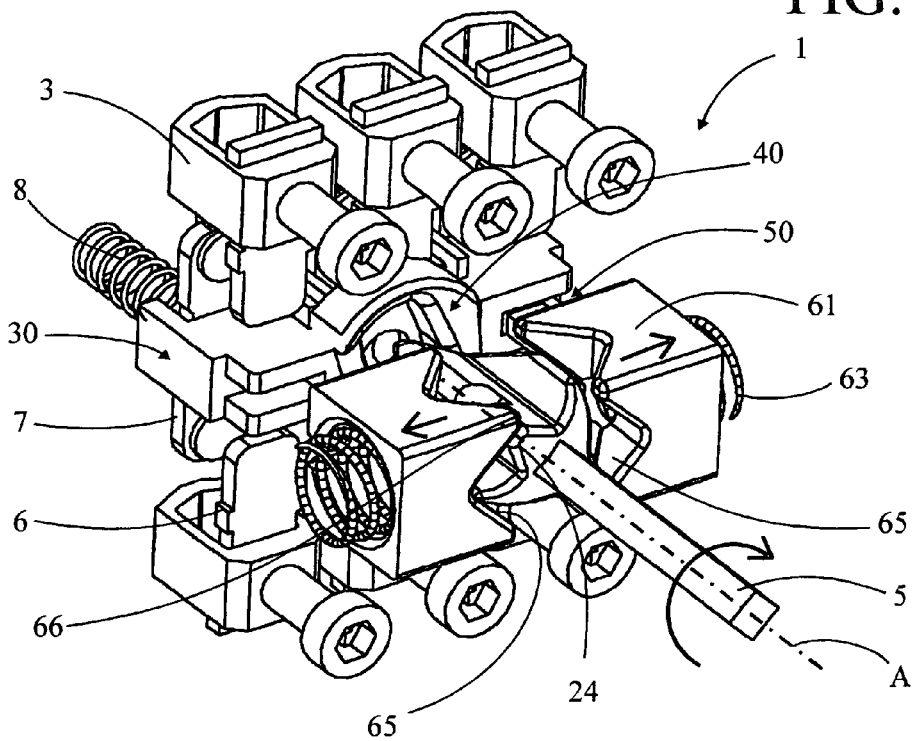
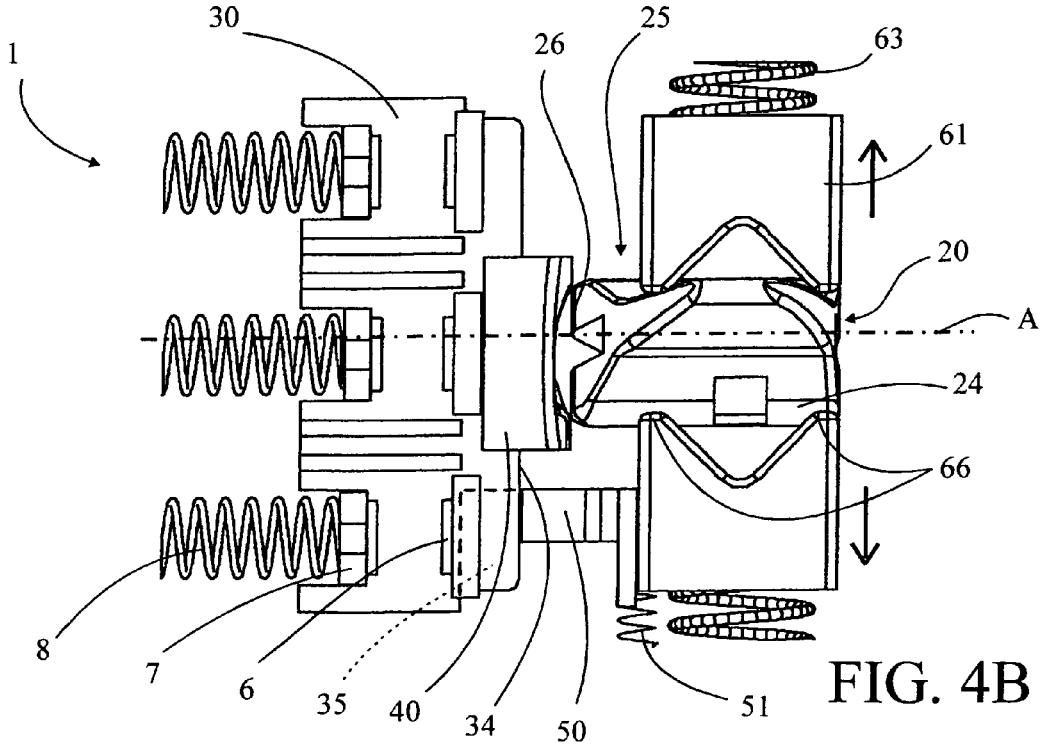
FIG. 4B

FIG. 3C
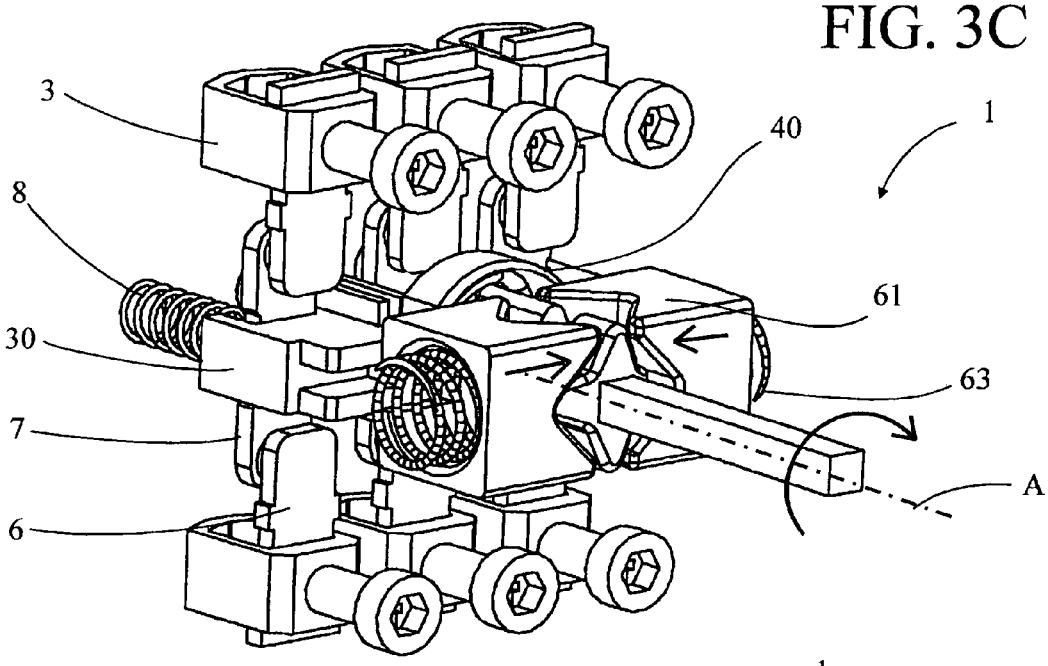
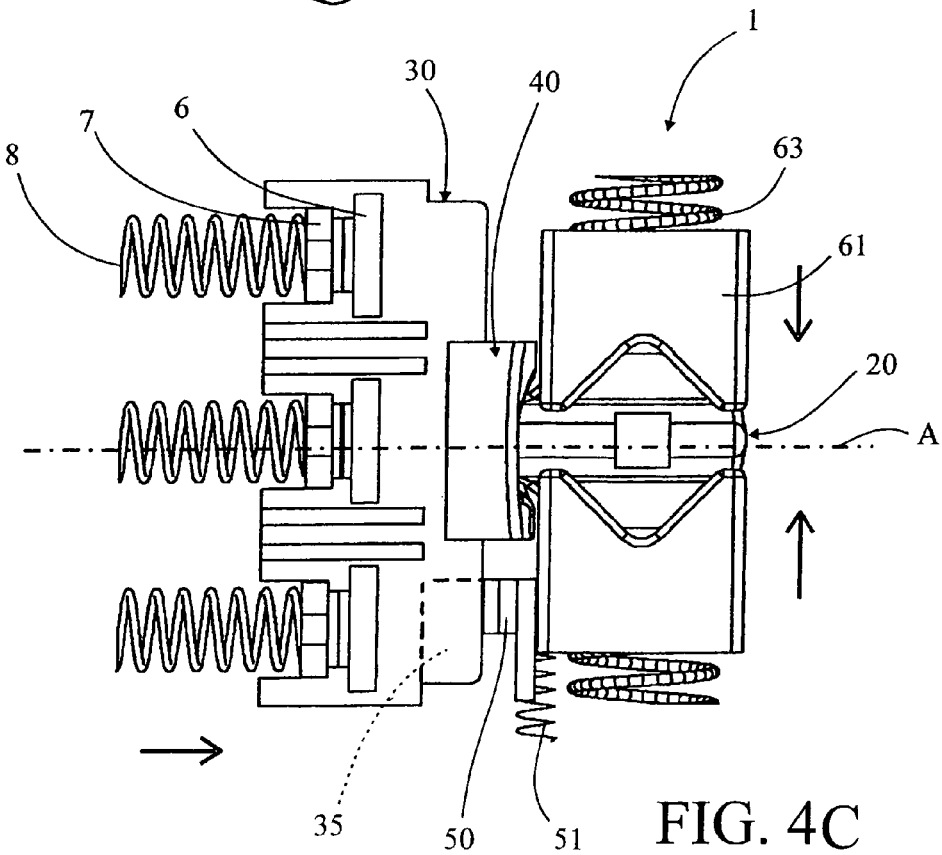
FIG. 4C

FRONT OR SIDE CONTROLLED ELECTRICAL SHUTOFF APPARATUS

FIELD OF THE INVENTION

The present invention concerns a front or side controlled electrical shutoff apparatus for an electrical installation comprising at least one case equipped with at least one pair of connecting terminals for connection to at least one electrical conductor on said installation and connected to a pair of fixed contacts, said case comprising at least one movable contact and at least one control rod traversing said case, connected on the exterior to a manipulation device and on the interior to said movable contact by means of a transmission mechanism which displaces it between a released position, where the movable contact is separated from the fixed contacts and the electrical circuit is open, and an engaged position, where it touches the fixed contacts and the electrical circuit is closed.

BACKGROUND OF THE INVENTION

Such shutoff apparatuses are commonly called switches, fusible switches, reverse switches, commutators, reverse commutators, etc., and they are designed to distribute energy throughout electrical installations or to supply industrial equipment, machine tools, etc., with alternating low voltage, in particular, for example, 380 V., with current ranging from several tens to several hundreds of amps.

Depending upon the electrical installation, the configuration of the electrical control panels and installation options, these shutoff apparatuses are manually controlled using a manipulation device that may consist of a rotating handle placed either on the front, called a "front handle," or on the side, called a "side handle," or even a pivoting lever generally placed on the front. These shutoff apparatuses may be controlled automatically, depending upon the situation, by a motor associated with the front or side control rod.

Depending upon whether front or side control is used, the transmission mechanism differs. Generally speaking, with front control, this transmission mechanism comprises a cam system for transforming the rotational movement of the handle, which is transmitted to the control rod, into translational movement by the movable contacts. With lateral control, this transmission mechanism is completed by a drive belt. In another mode currently used, the transmission mechanism is coupled with a rapid actuation device which, independent of the rotation speed of the handle or the pivoting of the lever, accelerates release and/or engagement as needed.

Consequently, there is a need to design different shutoff apparatuses as a function of both the range of current and the control mode (front or side). This means that for the same range of current, one shutoff apparatus is manufactured in several versions depending upon whether it is controlled from the front or the side. Certain manufacturers have proposed shutoff apparatuses called polyvalent apparatuses that are designed for adaptation to both front and side controls. However, these polyvalent shutoff apparatuses have complex, heavy transmission mechanisms with a large number of pieces and are not mechanically reliable, particularly in terms of longevity. Moreover, this affects the size of these pieces of equipment.

SUMMARY OF THE INVENTION

The present invention proposes overcoming these disadvantages with a shutoff apparatus that is polyvalent and responsive to all control modes, made with a minimum number of pieces, resulting in a simple, economical, mechanically reliable, standard size apparatus.

To achieve this, the invention concerns a shutoff apparatus. The transmission mechanism comprises at least one rotating control element that can be coupled with the control rod facing one of the two orthogonal control axles corresponding to one of the two control modes, front or side, respectively, so as to make the control element turn on one of the control axles, and at least one transmission element coupled with the movable contact to transform the rotation by said control element on one or the other of the two axles into translational movement by said movable contact between the released position and the engaged position, and vice versa.

In a preferred embodiment, the transmission mechanism comprises a rapid actuation device that cooperates with the rotating control element to make it turn automatically and quickly beyond a predetermined position of equilibrium.

This rapid actuation device may comprise at least one piston movable in translation within the case and compelled by a spring means toward the rotating control element, the piston and the rotating control element being designed to cooperate with each other along the diagonal of the three sided cam so that while it is alternating between the released and engaged positions, and vice versa, the rotating control element pushes the piston to meet its spring at the beginning of its course up to the position of equilibrium, and then the piston, influenced by the spring, pivots the rotary control element beyond the position of equilibrium to the end of its course.

Preferably, the rapid actuation means comprises two opposing pistons disposed symmetrically in relation to said rotating control element.

The rotating control element may be shaped like a four-pointed star in two orthogonal planes of symmetry defining eight angled surfaces and four tips, and the piston may comprise two V-shaped grooves in two orthogonal planes of symmetry defining four angled ramps and four points.

In the preferred embodiment the total course followed by the rotating control element when alternating between the released position and the engaged position, and conversely, is generally equal to 90° and its position of equilibrium is located essentially halfway between the released and engaged positions, that is, about 45°.

Advantageously, the rapid actuation device comprises at least one locking means designed to block the transmission element in at least the released position and at least as far as the transmission mechanism's position of equilibrium.

This locking means may be coupled with the piston and controlled by a recall means to move between at least a locked position in which it blocks the transmission element in said released position, and an unlocked position in which it frees the transmission element for displacement into the engaged position.

This locking element may be integral with the piston or it may consist of a piece that is separate from the piston.

The case may advantageously comprise an intermediate plate disposed between the transmission element and the piston, equipped with guide openings for the piston and the locking means.

In a preferred manner, the rotating control element and the transmission element are designed to cooperate with each other along the diagonal profile of the three-sided cam so that at least during the pivoting movement from the engaged position to the released position, the rotating control element turns freely on one or the other of the control axles, without displacing the transmission element from the beginning of its course to the position of equilibrium, then causes the transmission element to move translationally beyond the position of equilibrium to the end of its course.

In the preferred embodiment, the rotating control element comprises at least one V-shaped extremity defining a tip and two angled surfaces that are symmetrical in relation to a plane passing through its axis of symmetry, and the transmission element comprises opposite the rotating control element at least two angled ramps with different slopes which cooperate with the profiled extremity of the rotating control element when it turns on one or the other control axles, respectively.

BRIEF DESCRIPTION OF THE DRAWINGS

The features of the present invention will be better understood from the following description of one embodiment given by way of non-limiting example, with reference to the attached drawings, in which:

FIGS. 3A–C are partial perspective views of the shutoff apparatus of FIG. 2 controlled in front mode and respectively in the released, equilibrium, and engaged positions;

FIGS. 4A–C are overhead views corresponding to FIGS. 3A–C;

DETAILED DESCRIPTION OF THE INVENTION

With reference to the drawings, shutoff apparatus 1 of the invention may concern any type of shutoff apparatus such as a switch, a fusible switch, commutator, reverse commutator, etc., and it is designed to distribute electrical energy to industrial and/or domestic electrical installations, specifically, alternating low voltage over a range of current of from several tens to several hundreds of amps.

It comprises an electrically insulated case 2 of standard dimensions that can be mounted on normal rails in electrical control panels. The number of pairs of connecting terminals 3 or poles is adapted to the number of phases or conductors in the electrical installation, for example, three, in the examples shown. These connecting terminals 3 use screws, but may use springs or any other type of connection.

Figure 1A:
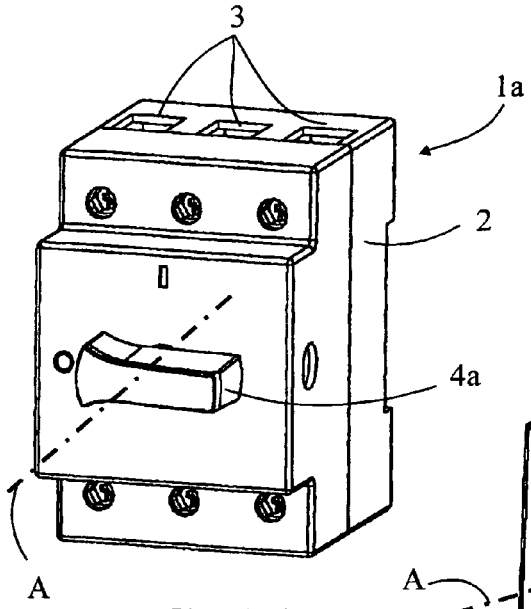
FIGS. 1A–D represent four different modes for the construction and/or control of the shutoff apparatus of the invention.
Figure 1B:
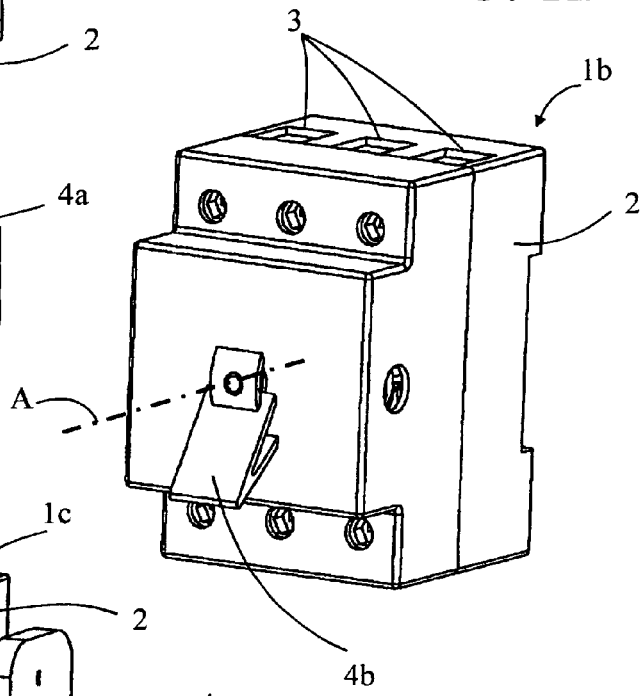
Figure 1C:
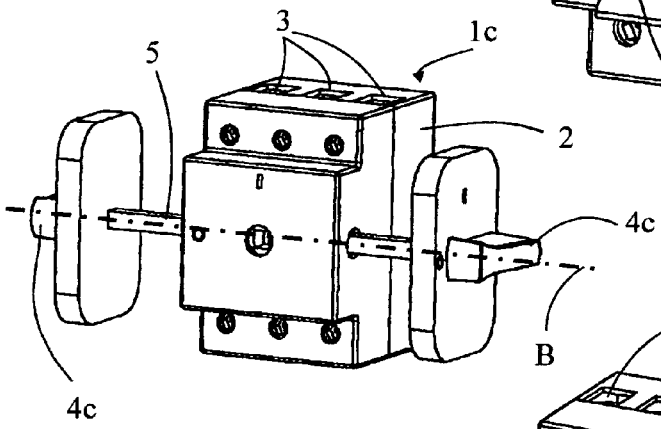
Figure 1D:
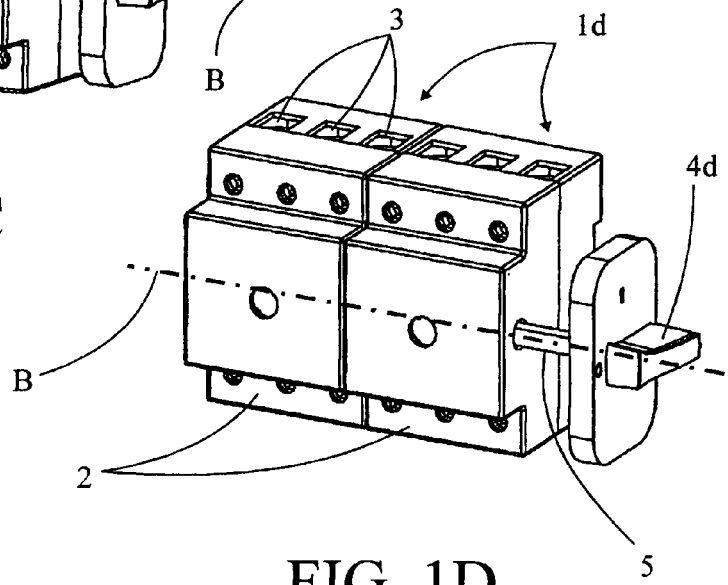

This type of shutoff apparatus 1 may be controlled by a manipulating element 4 outside the case 2 and mounted on the front surface or on the side and connected to a control rod 5. FIGS. 1A–D respectively illustrate four shutoff apparatuses 1 a-d controlled in four different modes: the front mode with a first control axle A, either using with handle 4*a* mounted on the front according to FIG. 1A and capable of rotating a quarter turn between two positions 0 and 1 or using lever 4*b* mounted on the front according to FIG. 1B, pivoting 90° between two positions 0 and 1, or in the side mode with a second control axle B perpendicular to the first, using one or two handles 4*c* mounted on the sides according to FIG. 1C and capable of rotating a quarter turn between two positions 0 and 1. The lateral control mode permits shutoff apparatuses 1*d* of the same or different caliber to be joined. One example is illustrated in FIG. 1D where two identical shutoff apparatuses 1*d* are joined to double the available number of connecting terminals 3, controlled simultaneously by a handle 4*d* mounted on one said of case 2 and an extending control rod 5 traversing the two cases 2.

Figure 2:
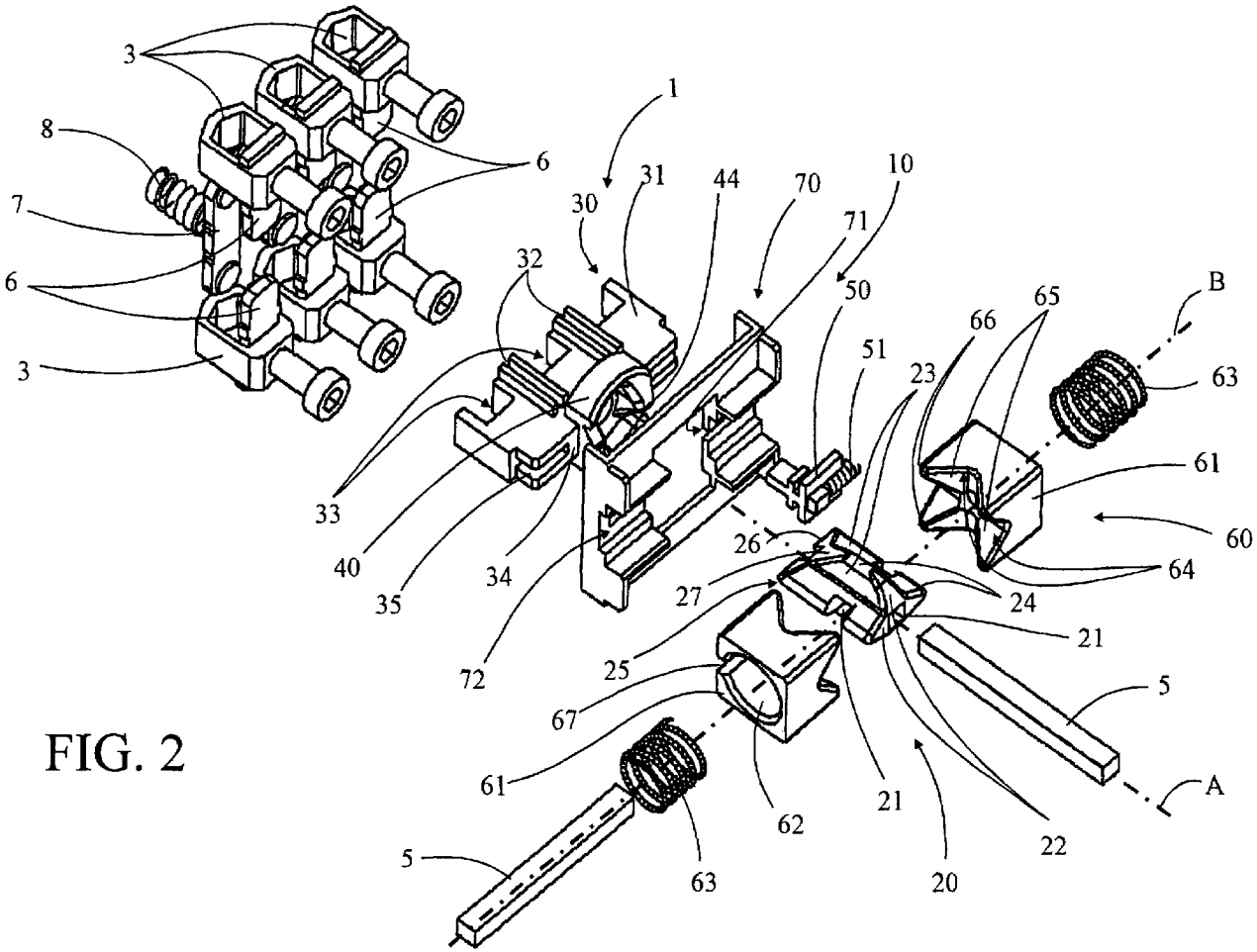
FIG. 2 is an exploded perspective view of the shutoff apparatus of FIGS. 1 without its case, representing the two possible control modes: the front mode and the side mode.

An exploded view of the interior of shutoff apparatus 1 according to the invention is shown in FIG. 2. It comprises three pairs of connecting terminals with screws 3, each coupled with a pair of fixed contacts 6. To each pair of fixed contacts 6 there corresponds a movable contact 7 capable of opening or closing the electrical circuit between fixed contacts 6 in the same pair. Movable contacts 7 are each subject to a recall element 8 compelling them towards fixed contacts 6 and they are simultaneously displaced by exterior manipulating element 4 through control rod 5 and a transmission mechanism 10 between a released position, in which movable contacts 7 are spaced apart from fixed contacts 6 and the electrical circuit is open, and an engaged position, in which they are in contact with fixed contacts 6 and the electrical circuit is closed.

Transmission mechanism 10 comprises a rotating control device 20 associated with control rod 5 oriented along the first or second control axle A, B corresponding to front or side control, respectively, and a transmission element 30 coupled with movable contacts 7 which transforms the rotation of control element 20 along one or the other of these control axles A, B into translational movement by movable contacts 7 between the released and engaged positions, and vice versa.

Rotating control element 20 consists of a movable piece that is not attached to case 2 (not shown). It comprises two square notches 21 with orthogonal axes, associated with the two control axles A and B, to receive and engage directly with the corresponding extremity of control rod 5, which is also square in section. Obviously, other types of connection may be used depending upon the section of control rod 5. This rotating control element 20 has a star shaped section with four branches 22 in two symmetrical orthogonal planes, defining eight angled surfaces 23 and four tips 24, with all the corners being rounded. The two planes of orthogonal symmetry are divided along an axis of symmetry shared with first control axle A. Rotating control element 20 comprises, opposite transmission element 30, a V-shaped profiled extremity 25 defining a rounded tip forming a linear finger 26 and two angled surfaces 27 that are symmetrical relative to a plane passing through the two control axles A and B.

Figure 7:
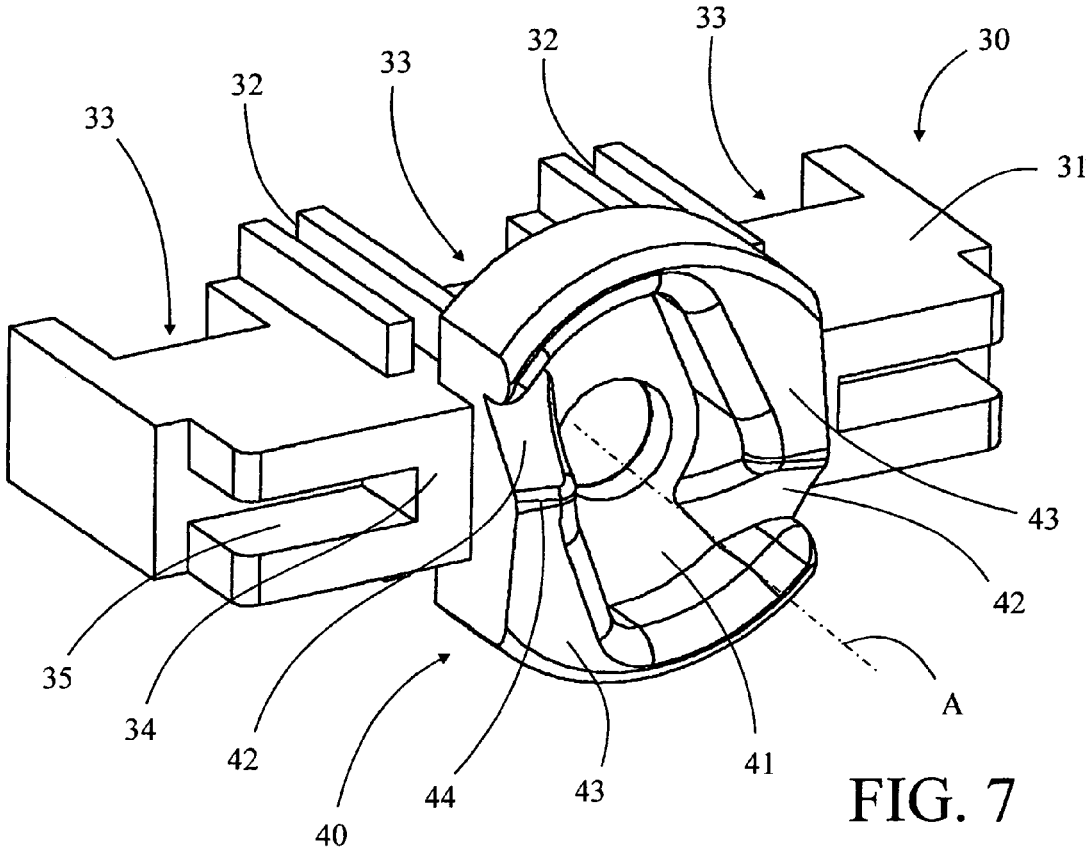
FIG. 7 is a detailed perspective of the transmission cam.

Transmission element 20 comprises a bar 31 movable in translation relative to case 2 (not shown) and guided by the latter using complementary shapes such as ribs sliding inside rails 32. This transmission element 30, shown in detail in FIG. 7, comprises on one side, guide housings 33 for movable contacts 7 and on the other side, a block with multiple cams 40 opposite rotating control element 20, a contact area 34 for a lock 50, and a groove 35 for lock 50 to circulate in. The multiple-cam block 40 is centered on control axle A and comprises a flat base 41 surrounded by two semi-annular raised areas diametrically opposed in relation to this control axle A defining two inclined ramps 42, 43 with different slopes. Flat base 41 has an angular section extending about 45° and is followed by a first steeply sloped inclined ramp 42 with an angular section of about 45°. This first inclined ramp 42 is doubled and diametrically opposed in relation to control axle A. The height of this first inclined ramp 42 is essentially equal to the course of movable contacts 7 between the released and engaged positions. This flat base 41 and this first angled ramp 42 cooperate with linear finger 26 formed at the profiled extremity 25 of rotating control element 20 when it is rotating around first control axle A. Second angled ramp 43 is less steeply sloped, extends for a section of about 90°, is opposite first angled ramp 42, doubled and diametrically opposed relative to control axle A. It cooperates with one of the angled surfaces 27 and the linear finger 26 on profiled extremity 25 of rotating control element 20 when it is rotating around second control axle B. Inclined ramps 42 and 43 with different slopes join each other two by two at a tip 44 forming an end ridge contained within a plane passing through the two control axles A and B.

Transmission mechanism 10 also comprises a rapid actuator 60 with two pistons 61 disposed on either side of rotating control element 20 and movable in translation relative to case 2 (not shown) in opposite directions. Each piston 61 comprises a central groove 62 for freely receiving control rod 5 in the lateral mode and is subject to spring 63 compelling it towards rotating control element 20 to ensure that it is in the correct stable position relative to case 2 and the other mechanisms. Each piston 62 comprises, opposite rotating control element 20, two V-shaped grooves 64 along two orthogonal planes defining four inclined ramps 65 and four tips 66, with all the corners being rounded.

This rapid actuator 20 also comprises at least one locking element 50 disposed between at least one of pistons 61 and transmission element 30. It moves translationally relative to case 2 (not shown) between at least one locked position in which it blocks transmission element 30 in at least the released position, and one unlocked position in which it frees that element for displacement into the engaged position. This lock element 50 is associated with one of the pistons 61 which drives it in the opposite direction from control element 20, and is subject to recall means 51 driving it in the other direction towards control element 20. In the example shown this lock element 50 consists of an L-shaped piece separate from piston 61 and translationally connected to it through an opening 27. In other variations that are not shown, it may be integral with the piston and have some degree of freedom to rotate relative to it. It is even possible to provide two lock elements 50 working simultaneously and in opposition.

Case 2 (not shown) comprises an intermediate plate 70 disposed between transmission element 30 and the unit formed of the locking element 20 and pistons 61. This intermediate plate 70 specifically comprises a translational guide groove 71 for locking means 50 and translational guide openings 72 for pistons 61. It allows guided translational movement by these pieces and also distributes the restraining forces of the lock when it is in the locked position, thus sparing pistons 61.

The operation of shutoff apparatus 1 of the invention will now be described with reference to FIGS. 3 and 4, corresponding to front control mode, that is, using control axle A.

Figure 3A:
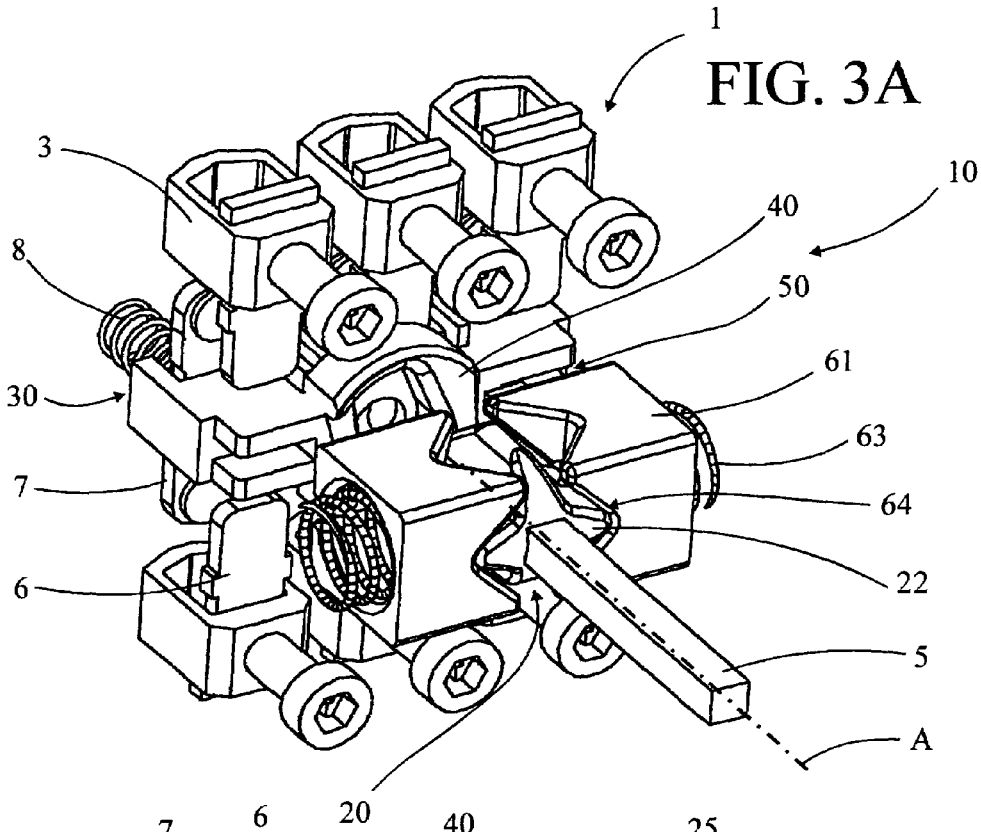
Figure 4A:
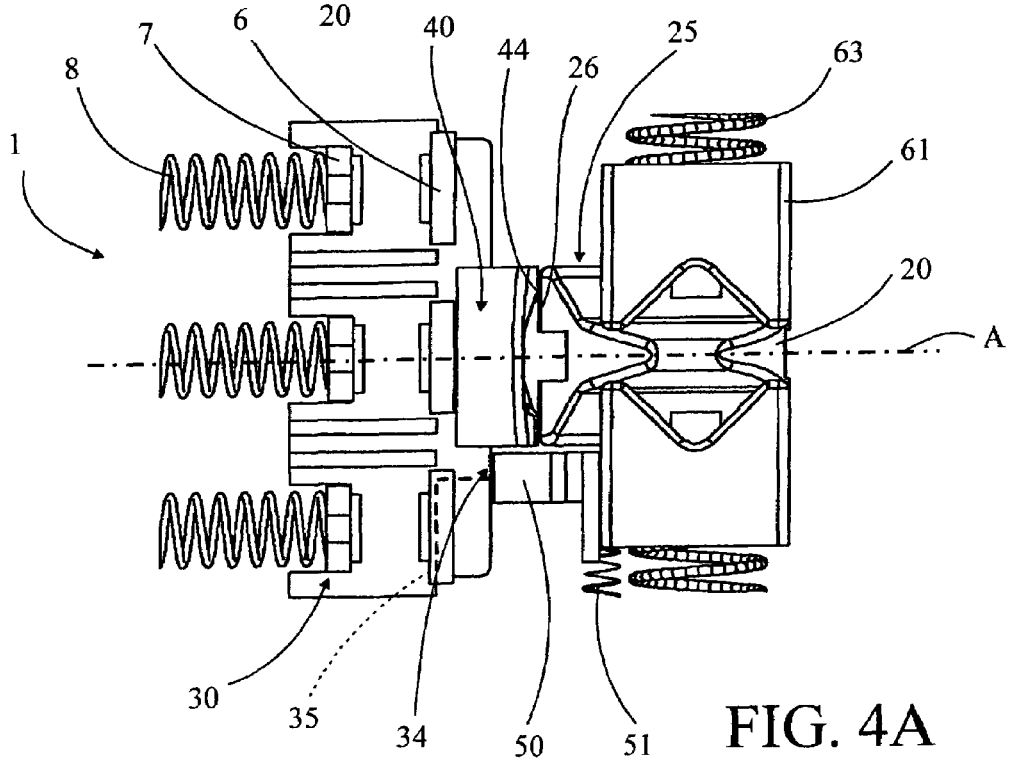

FIGS. 3A and 4A illustrate shutoff apparatus 1 in the released position. Rotating control elements 20 and transmission control elements 30 are in contact at their tips 26, 24, with linear finger 26 resting on tip 44 of multiple-cam block 40. Pistons 61 block rotating control element 20 in a stable position, with their spring means 63 being extended. Rotating control element 20 is in a stable position, given that its opposing branches 22 are housed in openings 64 in pistons 61. Locking element 50 blocks transmission element 30 in the released position, with its recall means 51 being extended. Recall elements 8 on movable contacts 7 are compressed.

FIGS. 3B and 4B illustrate shutoff apparatus 1 in the released position of equilibrium. The operator has turned the exterior handle 4 (not shown) for a one-eighth rotation, driving rotating control element 20 to a first portion on its course, a one-eighth turn on the diagonal of control rod 5 along control axle A. Tips 24 of the two opposing branches 22 of the star housed in the base of corresponding openings 64 in pistons 61 slide along corresponding inclined ramps 65, causing pistons 61 to move back and compressing spring means 63 toward tips 24, reaching points 66 on pistons 61, marking the position of equilibrium. Simultaneously, the return of one of the pistons 61 drives locking element 50 and compresses its recall means 51. Locking element 50 maintains transmission element 30 in the recessed position while it is in contact zone 34 and until it is opposite circulation groove 35.

FIGS. 3C and 4C illustrate shutoff apparatus 1 in the engaged position. By rotating exterior handle 4, the operator has surpassed the position of equilibrium, activating rapid actuation means 60 to pivot very quickly from the released position to the engaged position. When tips 24 of the two opposing branches 22 of the star leave corresponding points 66 on pistons 61, the resistance on spring means 63 is nullified, they become extended, and move closer to pistons 61 of rotating control element 20 while quickly and automatically causing it to rotate along the second portion of its course for a one-eighth rotation. Simultaneously, as locking element 50 has left contact zone 34 and faces circulation groove 35, no longer exerting any resistance on recall elements 8 of movable contacts 7, these elements relax, pushing on movable contacts 7 and causing transmission element 30 to move up into the engaged position. Simultaneously, profiled extremity 25 of rotating control element 20 lodges in multiple-cam block 40, with linear finger 26 abutting the flat base 41, allowing it to rotate on the second portion of its course. Shutoff apparatus 1 is in the engaged position.

To move into the released position the operator must turn exterior handle 4 in the reverse direction. On the first portion of the course, a one-eighth rotation, rotating control element 30 rotates for a one-eighth turn without any effect on transmission element 30, while linear finger 26 circulates inside flat base 42 of multiple-cam block 40. Simultaneously, tips 24 of the two other branches 22 of the star become active and slide along inclined ramps 65 of pistons 61, making them move back and compressing their spring means 63 until they reach corresponding tips 66, marking the position of equilibrium. Simultaneously, one of the pistons 61 drives locking element 50 with it, compressing its recall means 51.

Past the point of equilibrium, pistons 61 compelled by recall means 63 quickly and automatically cause control element 20 to rotate on the second portion of its course for a one-eighth rotation until it reaches a stable position with two opposing branches 22 of the star being housed in corresponding openings 64 in pistons 61. Simultaneously, linear finger 26 of profiled extremity 25 of rotating control element 20 circulates on the first steeply sloped inclined ramps 42, causing transmission element 30 to move back, movable contacts 7 to separate from fixed contacts 6, and recall elements 8 to compress. When rotating control element 20 has completed its course and the released position has been attained, locking element 50 moves near rotating control element 20 due to the action of its recall means 51, abutting contact zone 34 of transmission element 30 and blocking it in the released position. The pushing forces of recall elements 8 of movable contacts 7 are thus transmitted to locking element 50 and distributed within intermediate plate 70. Because of this design, pistons 61 are not subjected to any interfering forces that would disrupt their translational movement.

Figure 5A:
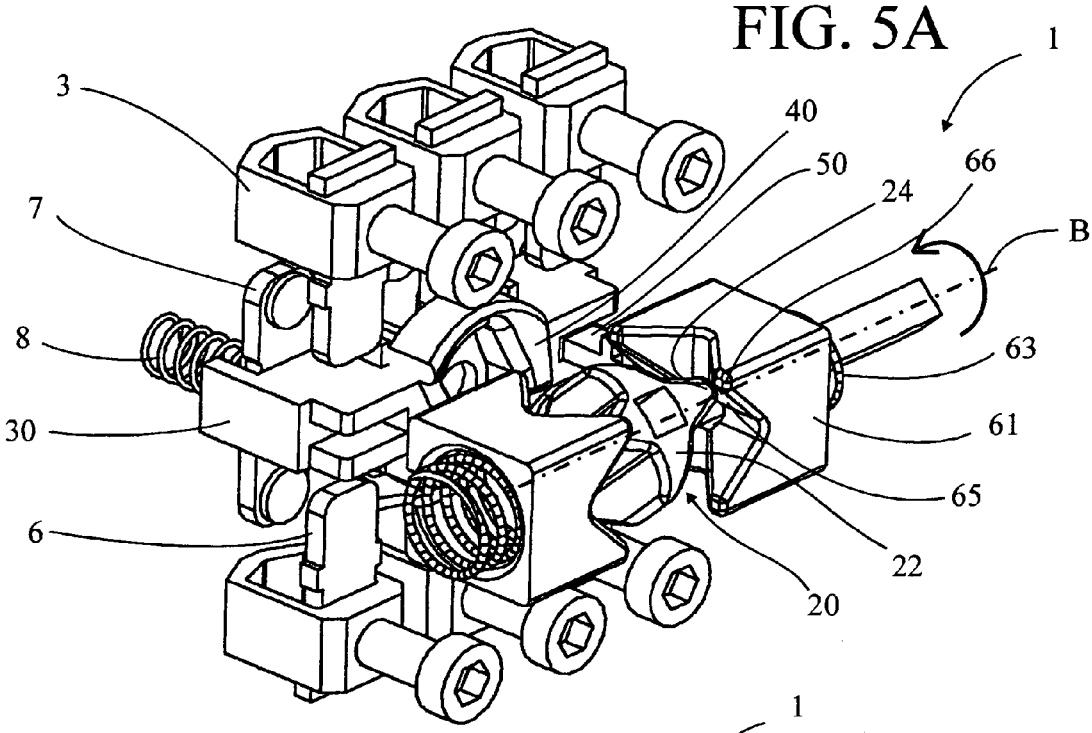
FIGS. 5A–B are partial perspectives of the shutoff apparatus of FIG. 2 controlled in the lateral mode, respectively in the equilibrium and disengaged positions.
Figure 5B:
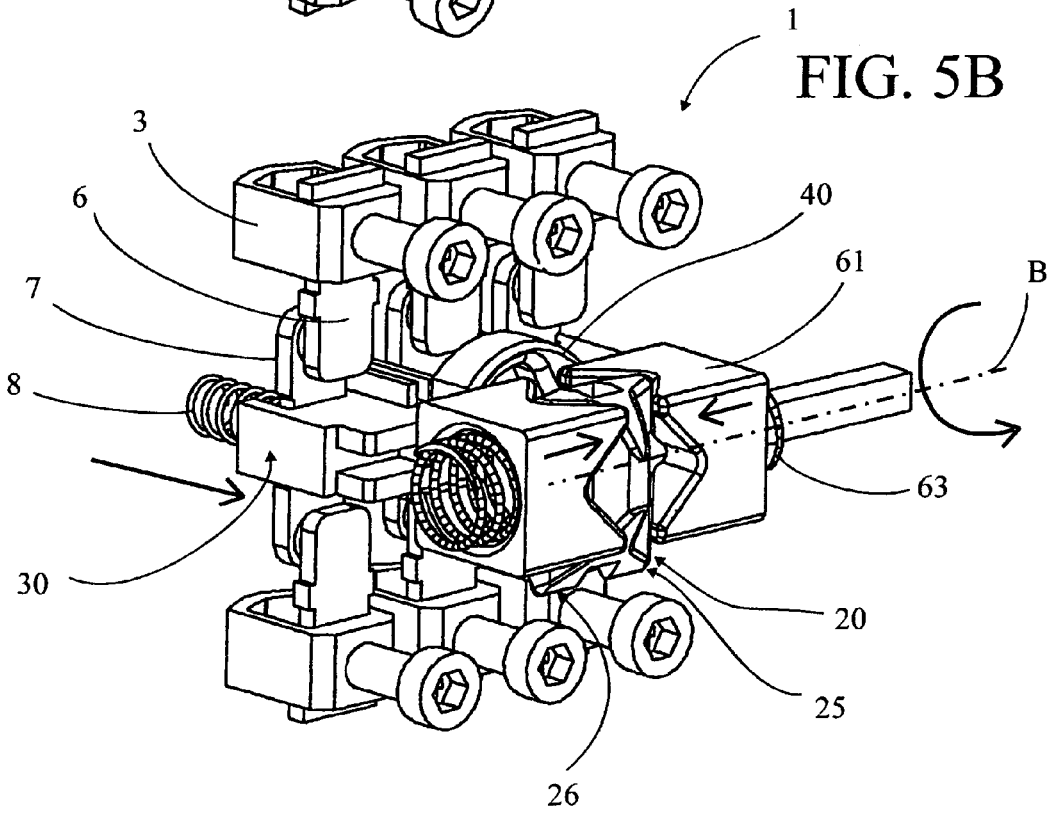

The operation of shutoff apparatus 1 of the invention in side control mode is essentially identical. With reference to FIGS. 5A–B, shutoff apparatus 1 is shown in equilibrium position and in engaged position, respectively, with the released position being the same as FIG. 3A. Control rod 5 is connected to rotating control means 20 along the second control axle B, causing it to rotate about this same control axle B in the direction in which exterior handle 4 (not shown) is rotated or pivoted. On the first part of the course, the two opposite branches 22 of the star circulate along corresponding inclined ramps 65 diametrically opposed to pistons 61, causing them to move them back. Simultaneously, profiled extremity 25 of rotating control element 20 turns freely without colliding into transmission element 30, the latter being blocked in the released position by locking element 50 as far as the equilibrium position (cf. FIG. 5A). Beyond this equilibrium position, pistons 61 quickly and automatically cause control element 20 to rotate along the second portion of its course, said rotation being possible due to the fact that profiled extremity 25 of rotating control element 20 remains outside multiple-cam block 40. Simultaneously, locking element 50 frees transmission element 30, which moves upward into the engaged position (cf. FIG. 5B).

Figure 6B:
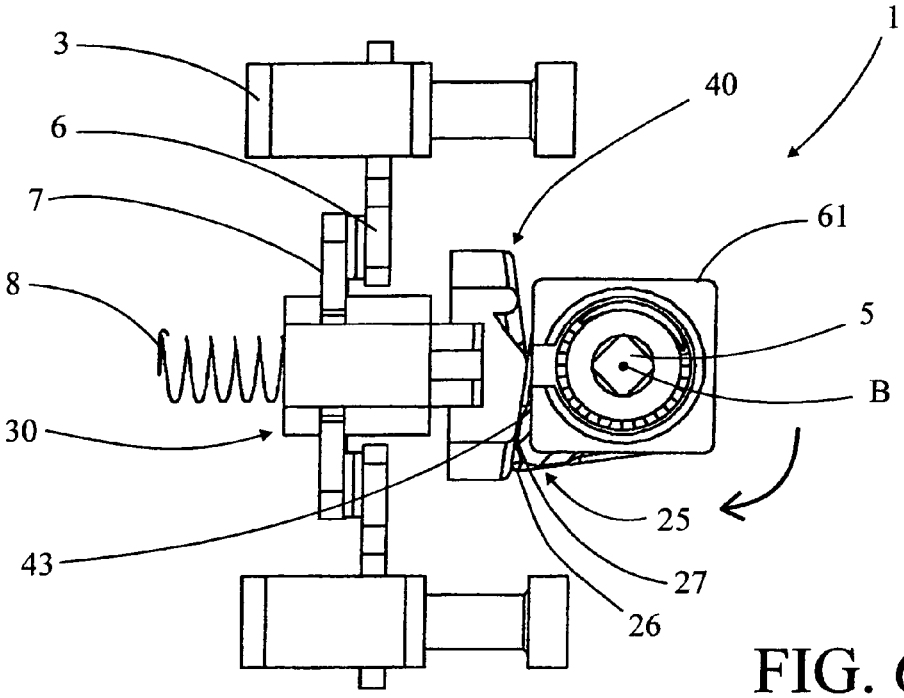
FIGS. 6A–C are side views corresponding to the shutoff apparatus of FIGS. 5A–B, respectively in the engaged, equilibrium, and released positions.
Figure 6A:
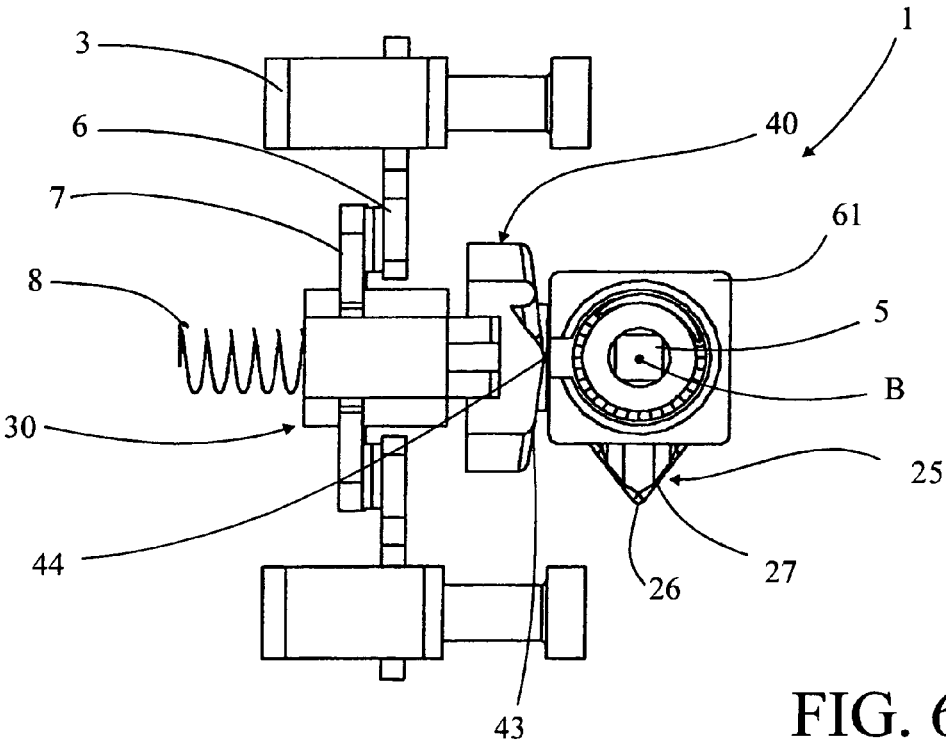
Figure 6C:
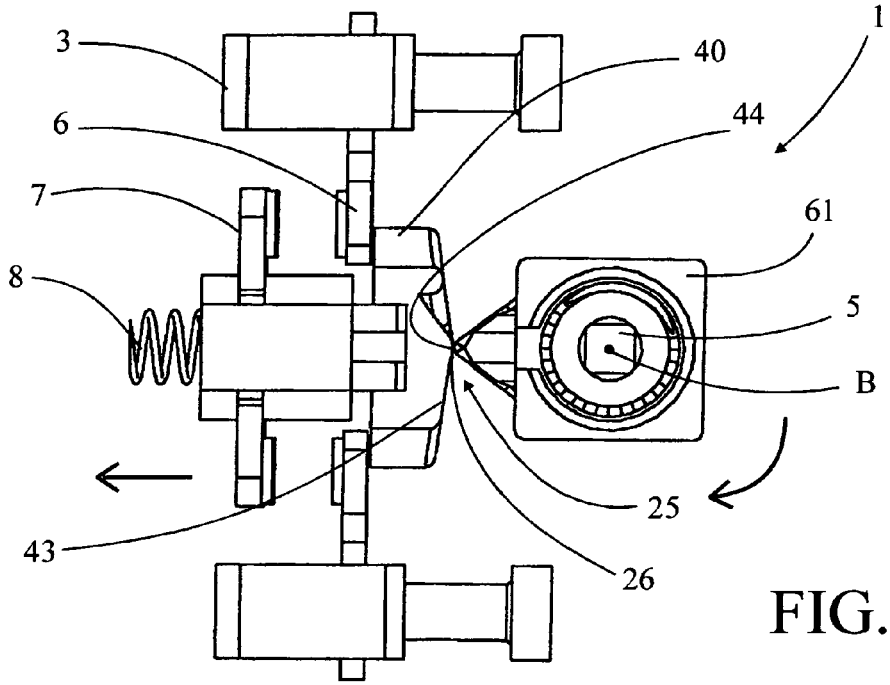

The pivoting movement of shutoff apparatus 1 of FIGS. 5A–B from the engaged to the released position is illustrated by FIGS. 6A–C. FIG. 6A corresponds to the engaged position of FIG. 5B. The operator actuates exterior manipulating element 4 to cause control element 20 to rotate about control axle B for the first part of its course, for a one-eighth rotation, until the equilibrium position is attained (cf. FIG. 6B). This rotation is possible because profiled extremity 25 of rotating control element 20 is located outside multiple-came block 40 and does not conflict with it. In the equilibrium position, one of the inclined surfaces 27 of this profiled extremity 25 comes into contact with one of the second slightly inclined ramps 43 on multiple-cam block 40. Having surpassed the equilibrium position, when pistons 61 quickly and automatically cause control element 20 to rotate on the second portion of its course for a one-eighth rotation, linear finger 26 provided on this profiled extremity 25 circulates along the second inclined ramp 43 on multiple-cam block 40, causing transmission element 30 to move back into the released position (cf. FIG. 6C), simultaneously locked by locking element 50.

This description clearly demonstrates that the invention achieves its stated goal, that is, a shutoff apparatus 1 equipped with a simple mechanism that can be controlled equally well in either the front or side mode. This option permits use of single model of a shutoff apparatus for a range of current or caliber and leaves the choice of command mode up to the end user. Moreover, it appears that the kinematic chain is very short, allowing optimal transmission of movement with no inertia, and limiting mechanical wear on the moving parts. The parts comprising this shutoff apparatus are primarily made of molded or injected synthetic material, which may or may not be reinforced, depending upon the degree of mechanical resistance desired, and with a low coefficient of friction, particularly the parts that are in sliding contact, i.e., control element 20, pistons 61 and transmission element 30.

The present invention is not limited to the exemplary embodiment described, but extends to all modifications and variations obvious to a person skilled in the art while still remaining within the scope of protection defined in the attached claims.

The invention claimed is:

1. An electrical shutoff apparatus (1) with one of a front and a side control for an electrical installation comprising at least one case (2) equipped with at least one pair of connecting terminals (3) for connection to at least one electrical conductor on said installation and connected to a pair of fixed contacts (6), said at least one case (2) comprising at least one movable contact (7) and at least one control rod (5) traversing a wall of said at least one case (2) and connected on an outside to of one of a rotating and a pivoting manipulating device (4) and on an inside to said at least one movable contact (7) through a transmission mechanism (10) for displacing the at least one movable contact (7) between a released position, where the at least one movable contact (7) is separated from the fixed contacts (6) and a circuit is open, and an engaged position, where the at least one movable contact (7) is in contact with the fixed contacts (6) and the electrical circuit is closed, said transmission mechanism (10) comprises at least one rotating control element (20) consisting of a movable piece that is not attached to case (2), said movable piece comprising two notches (21) with orthogonal axes (A, B) designed to directly receive said at least one control rod (5) oriented toward one of two orthogonal control axes (A, B), respectively corresponding to one of a front and lateral control modes, so as to make the at least one control element (20) turn on the one of the two orthogonal control axes (A, B), and at least one transmission element (30) connected to said at least one movable contact (7) to transform the rotation by said at least one control element (20) on the one of the two orthogonal control axes (A, B), into translational movement by said at least one movable contact (7) between said released and engaged positions, and conversely.

2. The apparatus according to claim 1, wherein said transmission mechanism (10) comprises a rapid actuation device (60) which cooperates with said rotating control element (20) to make the at least one rotating element (20) turn automatically and rapidly beyond a predetermined position of equilibrium.

3. The apparatus according to claim 2, wherein said rapid actuation device (60) comprises at least one piston (61) moving in translation inside said at least one case (2) and compelled by spring elements (63) towards said at least one rotating control element (20), the at least one piston (61) and said at least one rotating control element (20) cooperating with each other along a diagonal of a three-sided cam so that while the cam is pivoting between the released and engaged positions, and vice versa, the at least one rotating control element (20) pushes the at least one piston (61) to meet the spring elements (63) from a beginning of a course to said position of equilibrium, and then the at least one piston (61), activated by the spring elements (63) pivots the at least one rotating control element (20) beyond the position of equilibrium to an end of the course.

4. The apparatus according to claim 3, wherein said rapid actuation device (60) comprises two opposing pistons (61) disposed symmetrically relative to said rotating control element (20).

5. The apparatus according to claim 3, wherein said at least one rotating control element (20) has a star-shaped section with four branches (22) in two orthogonal planes of symmetry defining eight inclined surfaces (23) and four tips (24), the at least one piston (61) comprises two V-shaped grooves in two orthogonal planes of symmetry defining four inclined ramps (65) and four points (66).

6. The apparatus according to claim 3, wherein the rapid actuation device (60) comprises at least one locking element (50) for blocking said transmission element (30) in at least the released position and at least until the transmission element (10) reaches the position of equilibrium.

7. The apparatus according to claim 6, wherein said at least one locking element (50) is connected to said at least one piston (61) and compelled by spring elements (51) to move between at least one locked position, where said locking element (50) blocks said transmission element (30) in said released position, and one unlocked position, where said locking element (50) frees said at least one transmission element (30), allowing said locking element (50) to be displaced into the engaged position.

8. The apparatus according to claim 7, wherein said locking element is integral with said at least one piston.

9. The apparatus according to claim 7, wherein said locking element (50) is a separate piece from said at least one piston (61).

10. The apparatus according to claim 9, wherein said at least one case (2) comprises an intermediate plate (70) disposed between said at least one transmission element (30) and said at least one piston (61) and equipped with a guide opening (72, 71) for said piston (61) and said locking element (50).

11. The apparatus according to claim 9, wherein said at least one case (2) comprises an intermediate plate (70) disposed between said at least one transmission element (30) and said at least one piston (61) and equipped with guide openings (72, 71) for said at least one piston (61) and said locking element (50).

12. The apparatus according to claim 2, wherein the at least one rotating control element (20) comprises at least one V-shaped profiled extremity (25) defining a tip (26) and two inclined surfaces (27) that are symmetrical in relation to a plane passing through an axis of symmetry, the at least one transmission element (30) comprises opposite said at least one rotating control element (20) at least two inclined ramps (42,43) with different slopes which cooperate with the at least one profiled extremity (25) of said at least one rotating control element (20) when the at least one rotating control element (20) turns on the one of the orthogonal control axes (A, B), respectively.

13. The apparatus according to claim 2, wherein a total course followed by said at least one rotating control element (20) in pivoting between the released position and the engaged position, and vice versa, is generally equal to 90°, and the position of equilibrium is located essentially halfway between the released and engaged positions.

14. The apparatus according to claim 2, wherein said at least one rotating control element (20) and said at least one transmission element (30) cooperate with each other on a diagonal of a three-sided cam, so that at least while the at least one rotating control element (20) is pivoting between the engaged position and the released position, the at least one rotating control element (20) turns freely on the one of the orthogonal control axes (A, B) without displacing the at least one transmission element (30) from the beginning of a course to said position of equilibrium, and then causes said at least one transmission element (30) to be displaced in translation beyond said position of equilibrium to an end of the course.

* * * * *